US005626247A

United States Patent [19]

Hakala et al.

[11] Patent Number: 5,626,247

[45] Date of Patent: May 6, 1997

[54] PROCEDURE AND APPARATUS FOR MOVING THE MAIN GIRDER AND TROLLEY OF A CRANE

[75] Inventors: Ilpo Hakala, Hyvinkää; Soini Söderena, Röykkä, both of Finland

[73] Assignee: KCI Konecranes International Corporation, Finland

[21] Appl. No.: 325,259

[22] PCT Filed: Feb. 23, 1994

[86] PCT No.: PCT/FI94/00069

§ 371 Date: Dec. 21, 1994

§ 102(e) Date: Dec. 21, 1994

[87] PCT Pub. No.: WO94/19273

PCT Pub. Date: Sep. 1, 1994

[30] Foreign Application Priority Data

Feb. 24, 1993 [FI] Finland ..... 930810

[51] Int. Cl.[6] ..... B66C 5/04

[52] U.S. Cl. ..... 212/325; 212/322

[58] Field of Search ..... 212/320, 322, 212/325, 225, 228, 321

[56] References Cited

U.S. PATENT DOCUMENTS

| | | | |
|---|---|---|---|
| 3,154,025 | 10/1964 | Worthington | 212/225 |
| 3,249,236 | 5/1966 | Kummerman | 212/322 |
| 3,358,854 | 12/1967 | Montgomery | 212/325 |
| 3,945,503 | 3/1976 | Cooper | 212/274 |
| 4,106,641 | 8/1978 | Campbell et al. . | |
| 4,392,574 | 7/1983 | Theysken | 212/225 |

FOREIGN PATENT DOCUMENTS

| | | |
|---|---|---|
| 393731 | 4/1924 | Germany . |
| 1812805 | 6/1970 | Germany . |

*Primary Examiner*—Thomas J. Brahan

[57] ABSTRACT

A procedure for moving the main girder (3) and trolley (2) of a crane uses a gantry part (6) with its bracing structures and a traversing machinery with traversing ropes (4), the traversing machinery being mounted in conjunction with the gantry part. According to the procedure, the trolley is moved by the same traversing machinery as the main girder. When the main girder (3) is to be moved, the trolley (2) is interlocked so that it remains immovable with respect to the gantry (6) and the traversing movement is performed by winding one of the traversing ropes (4*a* or 4*b*) onto the winding drum (1) of the traversing machinery and at the same time unwinding the traversing rope (4*b* or 4*a*) on the opposite side from the winding drum (1). When the trolley (2) is to be moved, the trolley interlock is released and the traversing movement is performed in the manner described above.

18 Claims, 4 Drawing Sheets

PROCEDURE AND APPARATUS FOR MOVING THE MAIN GIRDER AND TROLLEY OF A CRANE

FIELD OF THE INVENTION

The present invention relates to a procedure for moving the main girder and trolley of a crane and to an apparatus therefore.

DESCRIPTION OF RELATED ART

In previously known technology, low-profile container cranes, especially those used in harbours, have a gantry part which can be moved longitudinally on the quay along rails provided for the crane. Mounted on the gantry part is a horizontal main girder which, when in the working position, extends over the ship at the quay. At the end of the working period, the main girder is moved away from its position over the ship to a rest position or to a new working position on the opposite side. In these low-profile cranes, this movement generally takes place in the horizontal direction. The main girder is provided with horizontal rails carrying a movable trolley which transfers the containers from the ship to the quay and vice versa. For moving the trolley, the machine room of the crane is provided with a traversing machinery comprising a traversing motor and a gear system, a winding drum and traversing ropes between the winding drum and the trolley. Moreover, the machine room contains a traversing machinery for moving the main girder which generally comprises the same kind of equipment as the traversing machinery moving the trolley. In addition to the two traversing machineries, the machine room contains a hoisting machinery comprising substantially the same kind of equipment as the traversing machineries. There are also solutions with two machine rooms, enabling one of the traversing machineries or the hoisting machinery to be placed in a separate machine room.

An obvious drawback with the previously known technology described above is that the machine room is crowded because it contains three different machineries. Further drawbacks are the difficulty of accommodating three different sets of ropes and the diverting pulleys needed for them, and the structural complexity and high cost resulting from the large number of parts. In this type of previously known solutions, the trolley generally moves along when the main girder is moved, involving the disadvantage of a complicated control arrangement. Another drawback involved is that the crane operator has to drive the trolley separately to a parking position or to walk along the main girder from the operator's cabin to a ladder or elevator on the gantry.

SUMMARY OF THE INVENTION

The object of the present invention is to eliminate the drawbacks mentioned above and to achieve a simple and reliable procedure for moving the main girder and trolley of a crane. The procedure of the invention is characterized by the trolley being moved by means of the same transversing machinery as the main girder.

The apparatus of the invention is characaterized by a locking mechanism which locks the trolley in place with respect to the gantry part.

The advantages provided by the solution of the invention are simplicity, reliability and reduced costs, because one of the traversing machineries can be left out altogether. A further advantage is a space saving both in the machine room and in the structures of the main girder as several ropes and diverting pulleys are left out. It follows from these advantages that the machineries can be more easily serviced because there is more room in the machine room and in the girder structures. Yet another advantage is that there is a fixed parking place for the trolley where it can be locked, so the crane operator has an easy access from the cabin to the stairway or elevator.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention is described in detail by the aid an application example by referring to the attached drawings which are given by way of illustration only, and thus are not limitative of the present invention, and, in which.

DESCRIPTION OF THE PREFERRED EMBODIMENTS

Figure 1:
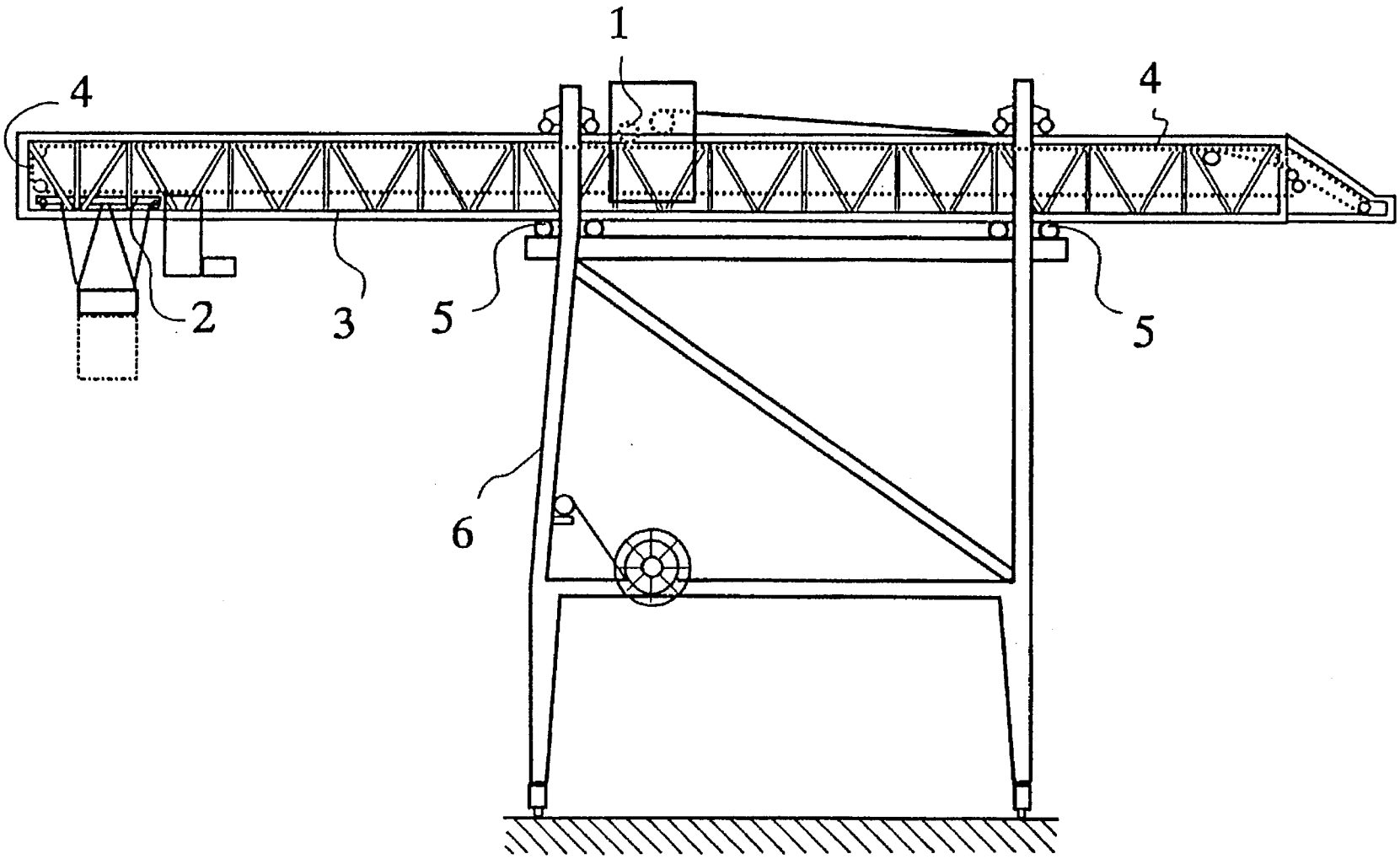
FIG. 1 presents a container crane according to the invention in lateral view.

For the sake of clarity, the figures have been simplified so that only the aspects most essential to the invention are shown. FIG. 1 shows an entire container crane in side view. The crane has a gantry 6 which supports a main girder 3 movably mounted in the upper part of the gantry, a trolley 2 moving along the main girder and a machine room containing the traversing and hoisting machineries. The machine room equipment includes a winding drum 1 for the traversing machinery, with traversing ropes 4 for the main girder and trolley going out from the drum. The gantry 6 consists of four legs and bracing structures connecting them. The main girder is mounted on the bracing structures in the upper part of the gantry so that it can move on its bearing wheels 5. The crane travels along rails on the quay, supported by bearing wheels placed at the lower ends of its legs.

Figure 2:
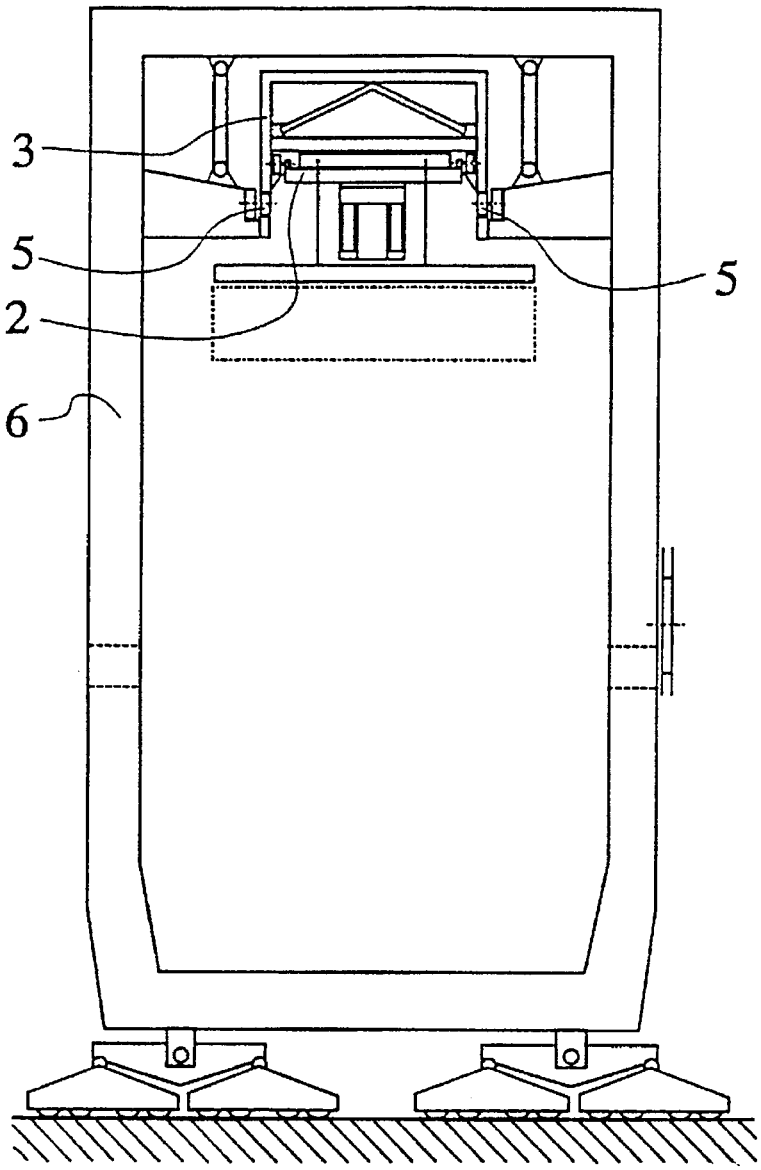
FIG. 2 presents a container crane according to the invention in front view.

FIG. 2 presents the container crane in front view, i.e. as seen from the side facing the sea. The figure shows in the first place the symmetric position of the main girder at the middle of the gantry part of the crane. The figure also shows the trolley 2, which must be of a very low design to enable it to move under the topmost bracing structures in the upper part of the gantry.

Figure 3:
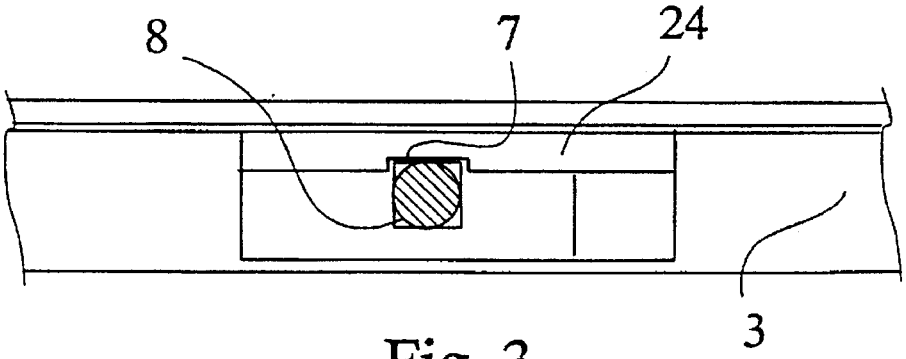
FIG. 3 presents a side view of the main girder interlock, sectioned along line III—III in FIG. 5.

FIG. 3 presents a detail showing how the main girder 3 is interlocked with the bracing structures in the upper part of the gantry. In its simplest form, the interlocking system consists of a locking piece 24 placed on one side of the upper surface of the main girder and provided with a locking notch 7, and a corresponding locking bar 8 fixed to a suitable place in the bracing structures 6 in the upper part of the gantry. The main girder is preferably provided with two locking pieces and locking bars on either side of it. The main girder can be locked in a working position, i.e. a position where the main girder is extended as far as possible towards the sea, and in a rest position, i.e. a retracted position. This is possible beacuse there are two locking bars 8 and locking notches 7 on each side of the main girder in its lengthwise direction; one pair of locking bars is at the seaward or front edge of the gantry, and the other pair at its rear edge. The locking notches are placed correspondingly in the main girder. The main girder is generally so interlocked that the locking bars lying closer to the heavier end of the girder are in their notches.

Figure 5:
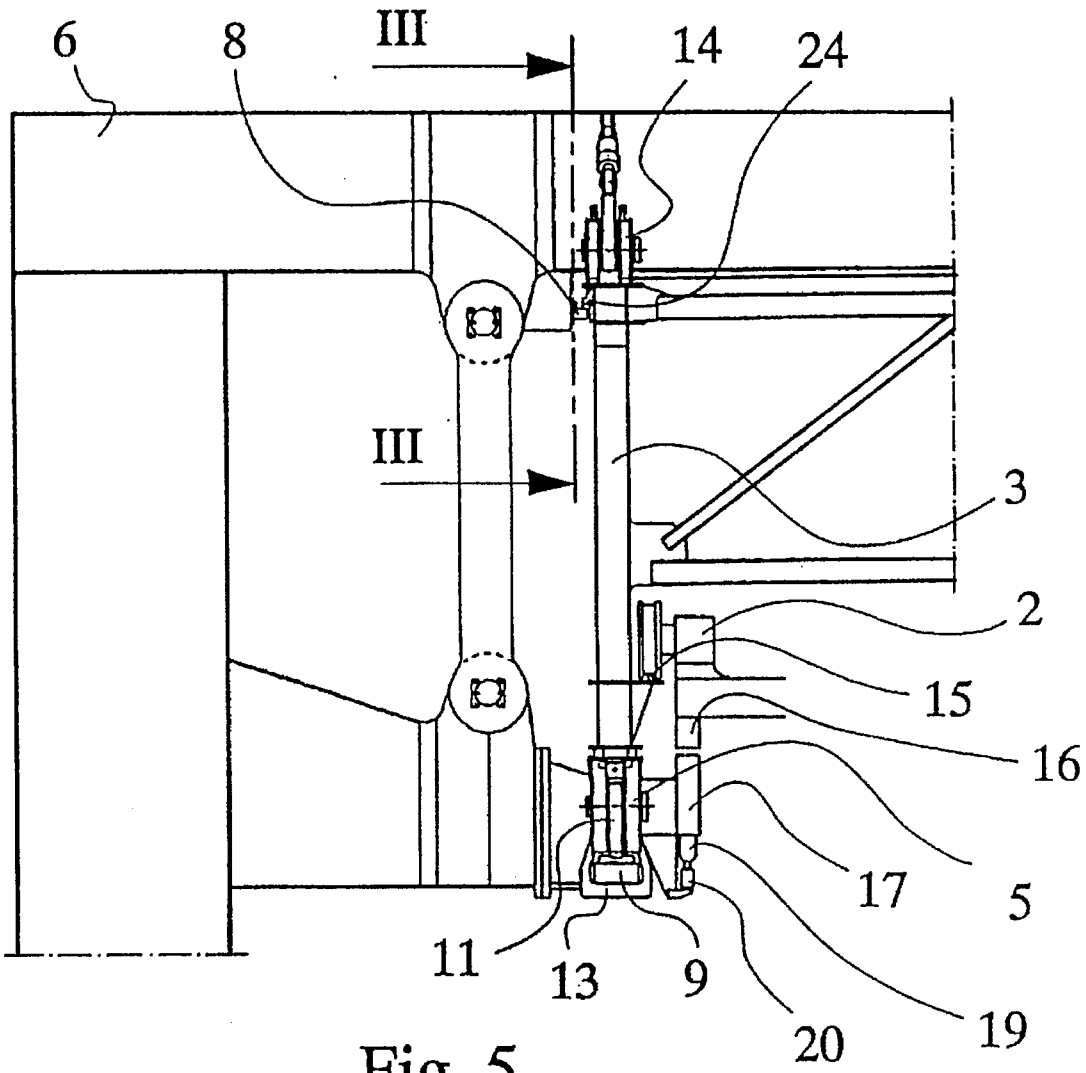
FIG. 5 presents the detail of FIG. 4 in front view.
Figure 4:
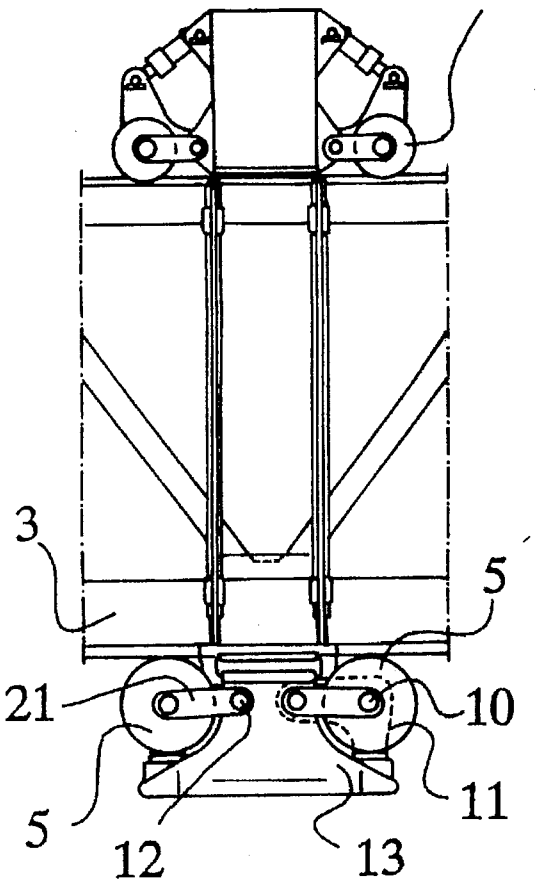
FIG. 4 presents a detail showing how the main girder is suspended on the gantry, i.e. on the leg structures of the crane, as seen from one side of the main girder.

FIGS. 4 and 5 present a more detailed illustration of the suspension of the main girder on the bracing structures 6 in the upper part of the gantry. The main girder 3 is suspended on the bracing structures in the upper part of the gantry mainly by eight suspension points placed in the upper part of the legs of the gantry 6. There are four suspension points below the main girder, two on each side, and four above it in alignment with those below.

A suspension point below the girder consists of a support block 13 fixed to the bracing structures of the gantry and provided with two pairs of bearing wheels 5 mounted on the block by means of two joints 12, two turnable brackets 11 and two guide rods 21, the two pairs of bearing wheels being placed on opposite sides of the support block 13 as seen from the side of the main girder 3. The joints 12 are placed at a distance from each other at the same height. Each pair of bearing wheels 5 is rotatably mounted at one end of the guide rods by means of an axle 10. In each pair, the bearing wheels 5 are placed on the axle 10 at a horizontal distance from each other. Mounted in the gap thus formed is a hydraulic lifting device 9 which lifts the bearing wheels 5 by the lower parts of the brackets 11.

When the main girder 3 is interlocked, the bearing wheel pairs 5 are in their low position and the main girder rests on the top of the support blocks 13. When the main girder is to be moved, the bearing wheel pairs 5 are first lifted up to their high position by means of the lifting devices 9, so that the main girder is now supported by the bearing wheels 5 instead of the support blocks 13. The bottom edge of the main girder is provided with a pair of rails on each side, said rails being in contact with the bearing wheels when the girder is being moved. The lifting devices 9 can be considered an elevation means for raising and lowering the main girders.

Each one of the overhead suspension points consists of two pairs of backing wheels 14 placed mutually symmetrically in the lengthwise direction of the main girder on either side of the suspension point. The backing wheels are pressed against the upper edge of the main girder by means of hydraulic cylinders. The purpose of the overhead suspension points is to keep the main girder in balance and to prevent it from being tilted when it is in its extended position and is handling a load.

FIG. 5 shows, in addition to the suspension of the main girder, part of the trolley 2 and a locking mechanism 17, 19, 20 for the trolley, said mechanism being fixed to the bracing structures in the uppper part of the gantry. Placed in the lower part of the elongated, essentially horizontal main girder 3 mounted on the bracing structures in the upper part of the gantry are two rails 15 laid in the longitudinal direction of the main girder at a horizontal distance from each other and serving as a running track for the trolley 2. On either side of the trolley, at its lower edge, is a locking boss 16 with a boring with its opening downwards. Correspondingly, attached to the bracing structures in the upper part of the gantry are two locking mechanisms 17, 19, 20 placed at a horizontal distance from each other so that the distance between them corrseponds to the horizontal distance between the locking bosses on the trolley. The location of the locking mechanisms is so chosen that the trolley will be interlocked in a place on the gantry that provides the operator an easy access to a stairway going down or to an elevator. The locking mechanism of the trolley consists of a frame part 17 attached to the bracing structures in the upper part of the gantry and having a vertical, cylidrical boring. Placed in the boring is a locking bar 19 which is moved in the vertical direction by a hydraulic cylinder 20 fixed to the frame part of the locking mechanism. The trolley is interlocked when the locking bar is pushed into its upper position and inserted into the boring in the locking boss. To enable the trolley to be correctly positioned at the time of interlocking, its location is determined e.g. by means of position sensors.

FIG. 5 also shows a locking bar 8 and a locking piece 24 placed close to the upper corner on the side of the main girder. In the situation illustrated by the figure, the interlock is open and the main girder is in the traversing position.

Figure 6:
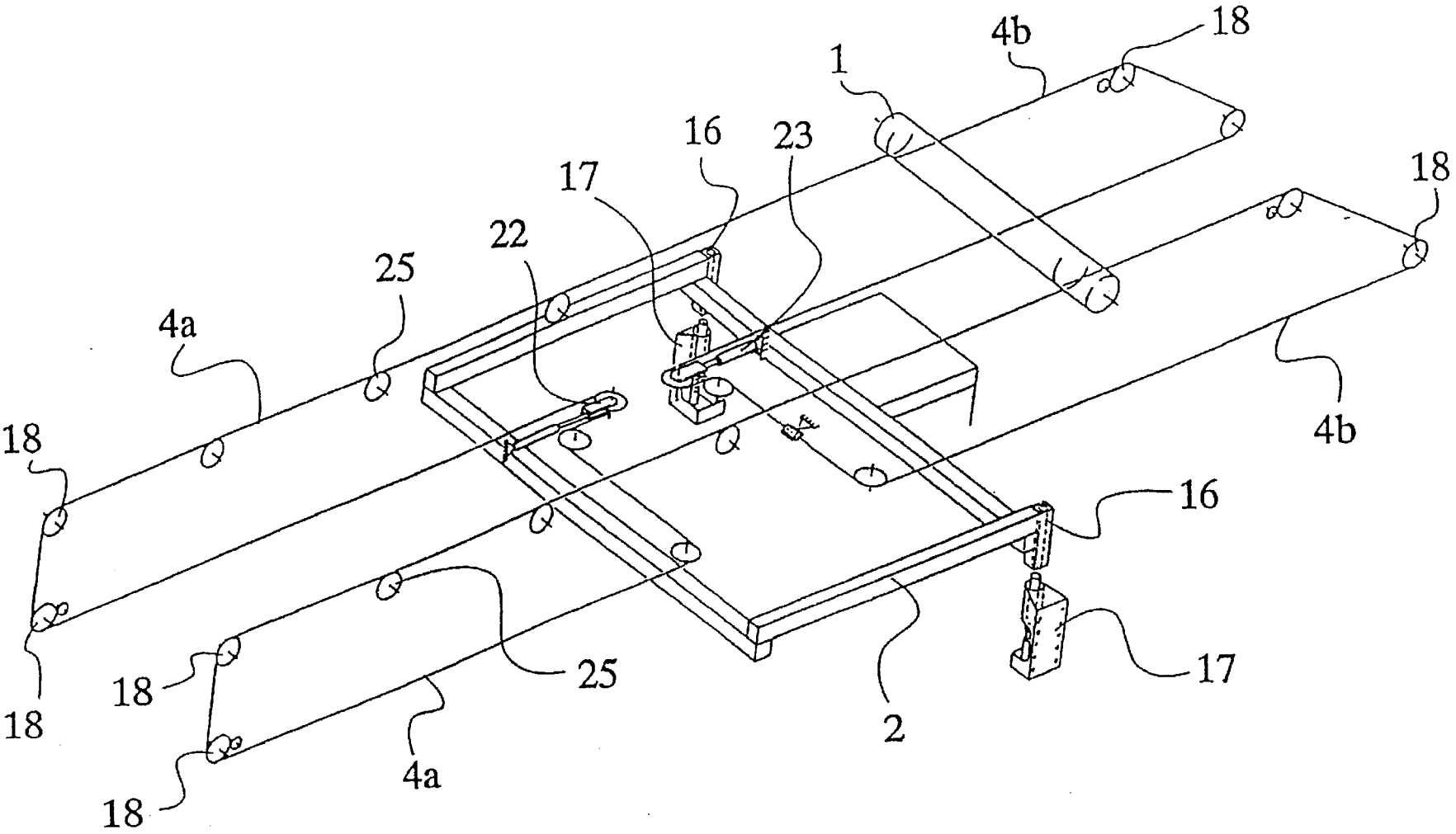
FIG. 6 presents a diagram of rope lay-out for the traversing machinery according to the invention.

FIG. 6 presents a rope lay-out diagram for the traversing machinery of the invention. On each side at each end, the main girder has diverting pulleys 18 for the traversing ropes 4. In addition, placed at suitable points on each side of the main girder are bearing rollers 25 for the traversing ropes 4. For the sake of clarity, the structural solutions relating to the hoisting machinery are not described in this context. Attached to the first half of the winding drum 1 of the traversing machinery is the first end of traversing rope **4*a*. The point of attachment may be e.g. close to the first end of the winding drum. The rope 4*a* goes from the drum to the first end of the first side of the main girder and further via diverting pulleys 18 to the trolley 2 and via a first set of tensioning elements 22 mounted on the trolley and via diverting pulleys mounted on the trolley to the first end of the second side of the main girder. From here, traversing rope 4*a* goes further via the diverting pulleys 18 at the first end of the second side of the main girder to the second half of the winding drum 1 of the traversing machinery, where the second end of the rope 4*a*** is attached. The point of attachment may be e.g. close to the end of the winding drum.

In a corresponding manner, the first end of traversing rope **4*b* is attached to the first half of the winding drum 1 of the traversing machinery, to a point removed from the point of attachment of the first end of rope 4*a* by at least a distance corresponding to the lateral advance of the rope. From the winding drum, traversing rope 4*b* goes in a direction opposite to that of rope 4*a*, i.e. towards the second end of the main girder. Having passed around the diverting pulleys at the second end of the first side of the main girder, the traversing rope goes to the trolley 2 and passes via a second set of tensioning elements 23 mounted on the trolley and via diverting pulleys mounted on the trolley to the second end of the second side of the main girder. Having passed around the diverting pulleys at this end, traversing rope 4*b* goes further to the second half of the winding drum 1 of the traversing machinery, where the second end of traversing rope 4*b* is fixed to a point removed from the point of attachment of the second end of rope 4*a* by at least a distance corresponding to the lateral advance of the rope. During the traversing movement, the traversing ropes 4*a* and 4*b* are wound around the winding drum in opposite directions, so that when traversing rope 4***a* is being wound onto the winding drum at each end of the drum, traversing rope 4*b* is correspondingly unwound from the winding drum at each end of the drum. The same occurs vice versa when the direction of the traversing movement is reversed.

The back-and-forth traversing movements of both the main girder and the trolley are performed by means of the same traversing machinery and the same traversing ropes 4. When the trolley 2 is to be moved, the main girder 3 is lowered onto its support blocks 13 at the interlocking points, causing the locking bars 8 attached to the upper gantry structure to be inserted into the locking notches 7 in the sides of the main girder 3. The main girder is now automatically locked in place without any separate action. After this, the traversing machinery is started and the trolley is driven to a desired position by means of the traversing ropes 4.

Correspondingly, when the main girder 3 is to be moved, the trolley 2 is first driven to an interlock position, whereupon it is interlocked with the bracing structures in the upper part of the gantry by means of the locking mechanism 17, 19, 20. Next, the main girder is released from its interlock with the gantry by lifting the girder onto its bearing wheels 5 by means of the lifting device 9. When the traversing machinery is now started, the trolley cannot move but the main girder will move in the direction of the traversal while the trolley remains immovable with respect to the gantry.

It is obvious to a person skilled in the art that the invention is not restricted to the example described above, but that the embodiments of the invention may be varied within the scope of the claims presented below. Thus, the traversing movements of both the trolley and the main girder can be controlled by means of previously known position sensors and/or limit switches to enable the correct interlock positions to be found. Similarly, the crane may have several interlock positions for both the main girder and the trolley if there is a need to define other interlock positions.

Also, the locking structures themselves may differ from those described above according to the solution most suitable in each case; for instance, the active part of the locking mechanism of the trolley can be placed on the trolley instead of on the gantry. Furthermore, it is possible under certain conditions to move the trolley even when the main girder is not interlocked; e.g. when the trolley is empty, its mass is lighter and the trolley moves more readily than the main girder resting on its bearing wheels or support blocks. Depending on the magnitude of the friction between the support block and the main girder, even a loaded trolley may move more readily than the main girder resting unlocked on its support blocks. Moreover, the traversing ropes 4 can be terminated on the trolley or the number of ropes may vary.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A method for moving a main girder and trolley of a crane, the crane having a gantry, the method comprising the steps of:

providing a first traversing rope and a second traversing rope, both the first and second traversing ropes being connected to the trolley and a drive for moving the main girder and trolley;

locking the trolley in place with respect to the gantry;

moving the main girder by the drive when the trolley is locked in place;

unlocking the trolley when the trolley is to be moved;

moving the trolley while the trolley is unlocked, the main girder being stationary relative to the gantry when the trolley is moving;

winding the first traversing rope and unwinding the second traversing rope by the drive when one of the main girder and the trolley is moving;

locking the main girder in position relative to the gantry when the trolley is moving, the step of moving the main girder by the drive comprises moving the main girder in a horizontal direction and wherein the step of locking the main girder comprises lowering the main girder relative to the gantry, and unlocking the main girder by lifting the main girder relative to the gantry prior to movement of the main girder in the horizontal direction.

2. The method according to claim 1, wherein the first traversing rope is wound and the second traversing rope is unwound when one of the main girder and trolley move in a first direction and wherein the method further comprises the step of unwinding the first traversing rope and winding the second traversing rope by the drive when one of the main girder and the trolley is moved in a second direction, the first direction being opposite to the second direction.

3. The method according to claim 1, wherein bearing wheels and a support block are mounted on the gantry and wherein the step of lifting the main girder comprises elevating the bearing wheels to lift the main girder from engagement with the support block, the main girder resting on the support block when locked in position.

4. The method according to claim 1, further comprising the step of positioning the trolley adjacent a stairway for an operator when the trolley is locked in position relative to the gantry.

5. The method according to claim 1, wherein the drive includes a winding drum, the steps of winding and unwinding include winding the first traversing rope on a first end of the winding drum while simultaneously unwinding the second traversing rope on a second end of the winding drum, the first and second ends of the winding drum being on opposite sides of the winding drum.

6. An apparatus for moving a main girder and trolley of a crane, the crane including a gantry, the apparatus comprising:

drive means for selectively moving the trolley and main girder;

a first traversing rope and a second traversing rope, both of the traversing ropes being connected to the trolley and to the drive means, the first traversing rope being wound by the drive means while the second traversing rope is unwound by the drive means during operation of the drive means;

locking means for locking the trolley in place with respect to the gantry, the main girder being movable by the drive means when the locking means locks the trolley in place and the trolley being movable by the drive means when the locking means releases the trolley; and means for locking the main girder in position relative to the gantry, the main girder being locked when the trolley is moving, wherein the drive means moves the main girder in a horizontal direction and wherein the means for locking raises and lowers the main girder relative to the gantry, the means for locking unlocks the main girder by lifting the main girder relative to the gantry prior to movement of the main girder in the horizontal direction.

7. The apparatus according to claim 6, wherein the main girder and trolley are movable in first and second directions, the first direction being opposite to the second direction, the first traversing rope being wound by the drive means and the second traversing rope being simultaneously unwound by the drive means when one of the main girder and trolley move in the first direction, and the first traversing rope being unwound by the drive means and the second traversing rope being simultaneously wound by the drive means when one of the main girder and trolley move in the second direction.

8. The apparatus according to claim 6, further comprising bearing wheels and a support block mounted on the gantry and wherein the means for locking the main girder includes a lifting device for raising the bearing wheels to lift the main girder from engagement with the support block, the main girder resting on the support block when locked in position.

9. The apparatus according to claim 6, wherein the gantry has a stairway for an operator, the trolley being adjacent the stairway when locked in position relative to the gantry.

10. The apparatus according to claim 6, wherein the drive means includes a winding drum, the first traversing rope being wound on a first end of the winding drum while simultaneously the second traversing rope is unwound on a second end of the winding drum, the first and second ends of the winding drum being on opposite sides thereof.

11. The apparatus according to claim 6, wherein the first traversing rope is connected to the trolley by a first set of tensioning elements and wherein the second traversing rope is connected to the trolley by a second set of tensioning elements.

12. An apparatus for moving a main girder and trolley of a crane, the crane including a gantry, the apparatus comprising:

drive means for selectively moving the trolley and main girder;

at least one traversing rope connected to the trolley and to the drive means;

locking means for locking the trolley in place with respect to the gantry, the main girder being movable by the drive means when the locking means locks the trolley in place and the trolley being movable by the drive means when the locking means releases the trolley; and elevation means for raising and lowering the main girder with respect to the gantry, the elevation means raising the main girder relative to the gantry when the main girder is to be horizontally moved and the elevation means lowering the main girder when the main girder is fixed in position relative to the gantry.

13. The apparatus according to claim 12, wherein the drive means moves the trolley when the elevation means lowers the main girder.

14. The apparatus according to claim 12, wherein the main girder and trolley are movable in first and second directions, the first direction being opposite to the second direction, the first traversing rope being wound by the drive means and the second traversing rope being simultaneously unwound by the drive means when one of the main girder and trolley move in the first direction, and the first traversing rope being unwound by the drive means and the second traversing rope being simultaneously wound by the drive means when one of the main girder and trolley move in the second direction.

15. The apparatus according to claim 12, further comprising bearing wheels and a support block mounted on the gantry and wherein the elevation means includes a lifting device for raising the bearing wheels to lift the main girder from engagement with the support block, the main girder being engagable with the support block when the elevation means lowers the main girder, when resting on the support block, the main girder being locked in position.

16. The apparatus according to claim 12, wherein the gantry has a stairway for an operator, the trolley being adjacent the stairway when locked in position relative to the gantry.

17. The apparatus according to claim 12, wherein the drive means includes a winding drum, the first traversing rope being wound on a first end of the winding drum while simultaneously the second traversing rope is unwound on a second end of the winding drum, the first and second ends of the winding drum being on opposite sides thereof.

18. The apparatus according to claim 12, wherein the first traversing rope is connected to the trolley by a first set of tensioning elements and wherein the second traversing rope is connected to the trolley by a second set of tensioning elements.

* * * * *